US006923687B2

(12) United States Patent
Wang

(10) Patent No.: US 6,923,687 B2
(45) Date of Patent: Aug. 2, 2005

(54) AUDIO JACK HAVING IMPROVED CONTACTS

(75) Inventor: Nina Wang, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 1 day.

(21) Appl. No.: 10/890,087

(22) Filed: Jul. 12, 2004

(65) Prior Publication Data

US 2005/0009407 A1 Jan. 13, 2005

(30) Foreign Application Priority Data

Jul. 11, 2003 (TW) ..... 92212810 U

(51) Int. Cl.[7] ..... H01R 24/04
(52) U.S. Cl. ..... 439/668; 439/188; 439/344
(58) Field of Search ..... 439/668, 188, 439/344, 108, 607, 676

(56) References Cited

U.S. PATENT DOCUMENTS 4,392,708 A * 7/1983 Bailey et al. ..... 439/668
4,937,404 A * 6/1990 Kitagawa ..... 200/51.09
6,220,898 B1 * 4/2001 Wu ..... 439/668
6,478,629 B1 11/2002 Li et al.
2002/0052148 A1 * 5/2002 Nagata ..... 439/668
2002/0052149 A1 * 5/2002 Suzuki et al. ..... 439/668

* cited by examiner

*Primary Examiner*—Hien Vu
(74) *Attorney, Agent, or Firm*—Wei Te Chung

(57) ABSTRACT

An audio jack connector comprises a rectangular-shaped insulating housing, and a plurality of different contacts. The insulative housing has a base, and a mating portion. A channel extends through the base and the mating portion. A front end of the channel defines a gap, and a number of receiving slits defined on the base at two sides of the channel, the base defining a depression communicating with the channel at a top wall thereof. A first and a second contacts are received in the slits. A third contact mates with the top wall and comprises a mounting portion extending beyond the bottom wall of the insulative housing. A fourth contact is installed in a front end of the insulative housing and has an engaging portion extending through the gap and inserted into the front end of the channel for electrically connecting the mating plug connector.

5 Claims, 4 Drawing Sheets

AUDIO JACK HAVING IMPROVED CONTACTS

BACKGROUND OF THE INVENTION

1. Field of the Invention

The present invention generally relates to an electrical connector, and particularly to an audio jack connector provided with improved contacts, wherein the audio jack connector can achieve a good electrical connection with a mating plug connector.

2. Description of Related Art

A computer is required to provide connectors at input/output ports, which are usually mounted on a main printed circuit board (PCB) thereof, to mate with corresponding complementary connectors of peripheral devices for signal transmission therebetween. With the development of micro electric devices, audio socket connectors are used in these electric devices more and more.

U.S. Pat. No. 6,478,629 discloses such an audio jack connector comprises an insulative casing and a plurality of conductive terminals and a side mount grounding terminal. The contacts are plate-shaped, an interior space is defined in the casing for receiving a pin of a mating plug, one side face of the casing defines a window communicating with the interior space via a slit communicated with the window. The grounding terminal includes a horizontal plate portion received in the slit. All the conductive terminals are assembled to insulative housing from a rear-to-front or bottom-to-up direction. Each contact is received in a corresponding slot. Therefore, the internal structure of the insulative housing is complex, and in order to sufficiently utilize limited area of the main PCB, diminishing sizes of connectors are needed. So, it is difficult to assemble the plate-shaped contacts into the insulative housing and ensure a good electrically connection thereof.

Hence, an audio jack connector with improved contacts is desired to overcome the disadvantages of the related art.

BRIEF SUMMARY OF THE INVENTION

Accordingly, it is an object of the present invention to provide an audio jack connector having improved contacts for minimizing occupied space thereof.

It is another object of the present invention to provide an audio jack connector having improved contacts which can prevent electromagnetic interference for achieving a good electrically connection.

In order to achieve the above-mentioned objects, an audio jack connector in accordance with the present invention comprises an rectangular-shaped insulative housing, and a plurality of different contacts including a first, second, third, and fourth contacts.

The insulative housing comprises a base, a mating portion for mating with a mating plug connector, a channel extending through the base and the mating portion. A front end of the channel defines a gap, and a number of receiving slits are defined on the base at two sides of the channel. The base defines a depression communicating with the channel at a top wall thereof. The first and second contacts are received in the slits. Each contact has a mounting portion extending through and exposed outside a bottom wall of the insulative housing, and an engaging portion extending into the channel for electrically connecting the mating plug connector. The third contact mates with the top wall and comprises a mounting portion extending beyond the bottom wall of the insulative housing, a connecting portion received in the depression, and an engaging portion extending into the channel for electrically connecting the mating plug connector. The fourth contact is installed in a front end of the insulative housing and has a mounting portion extending beyond the bottom wall of the insulative housing, and an engaging portion extending through the gap and inserted into the front end of the channel for electrically connecting the mating plug connector.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
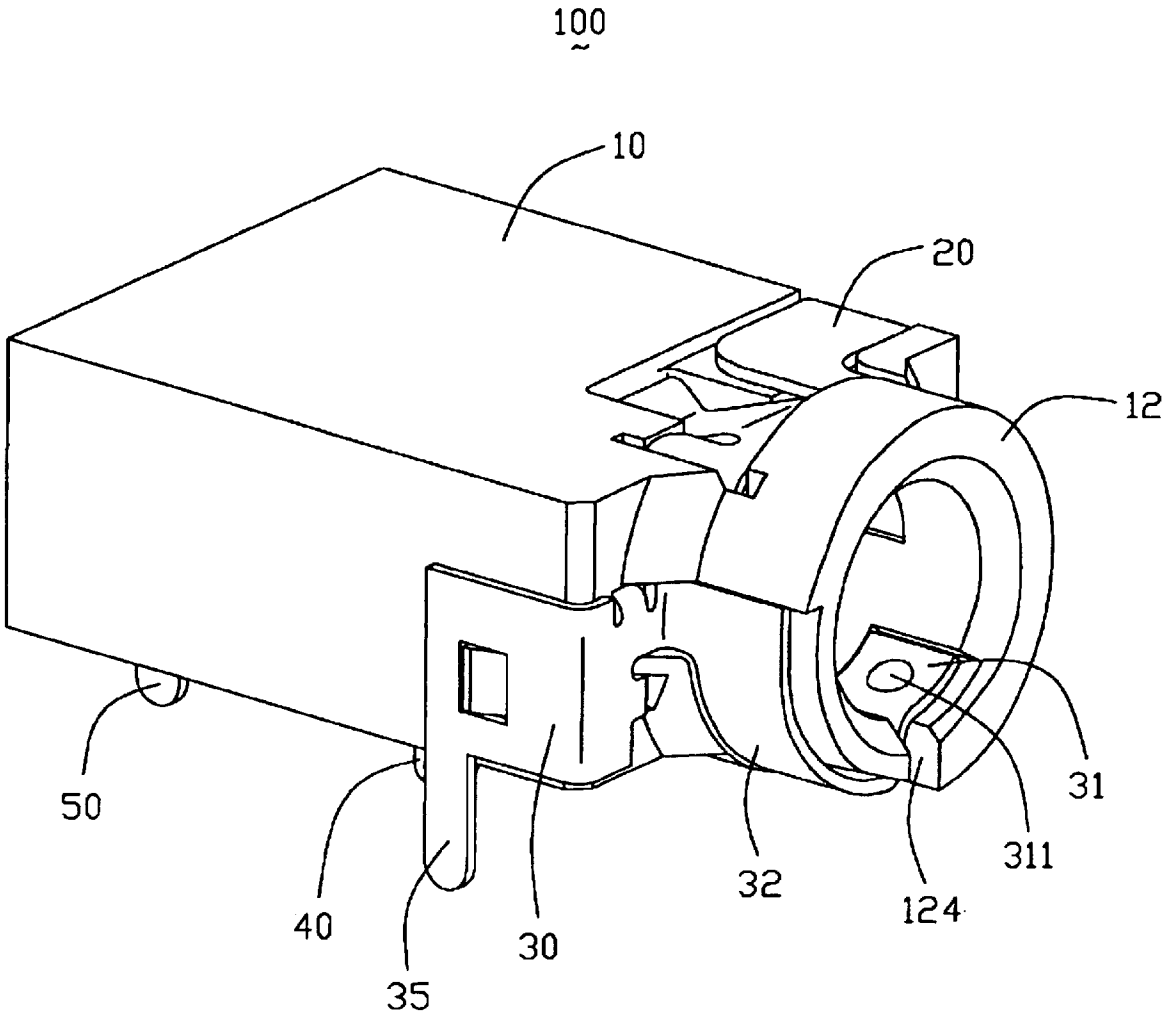
FIG. 1 is an assembled, perspective view of an audio jack connector in accordance with the present invention.

Reference will now be made to the drawing figures to describe the present invention in detail.

Figure 2:
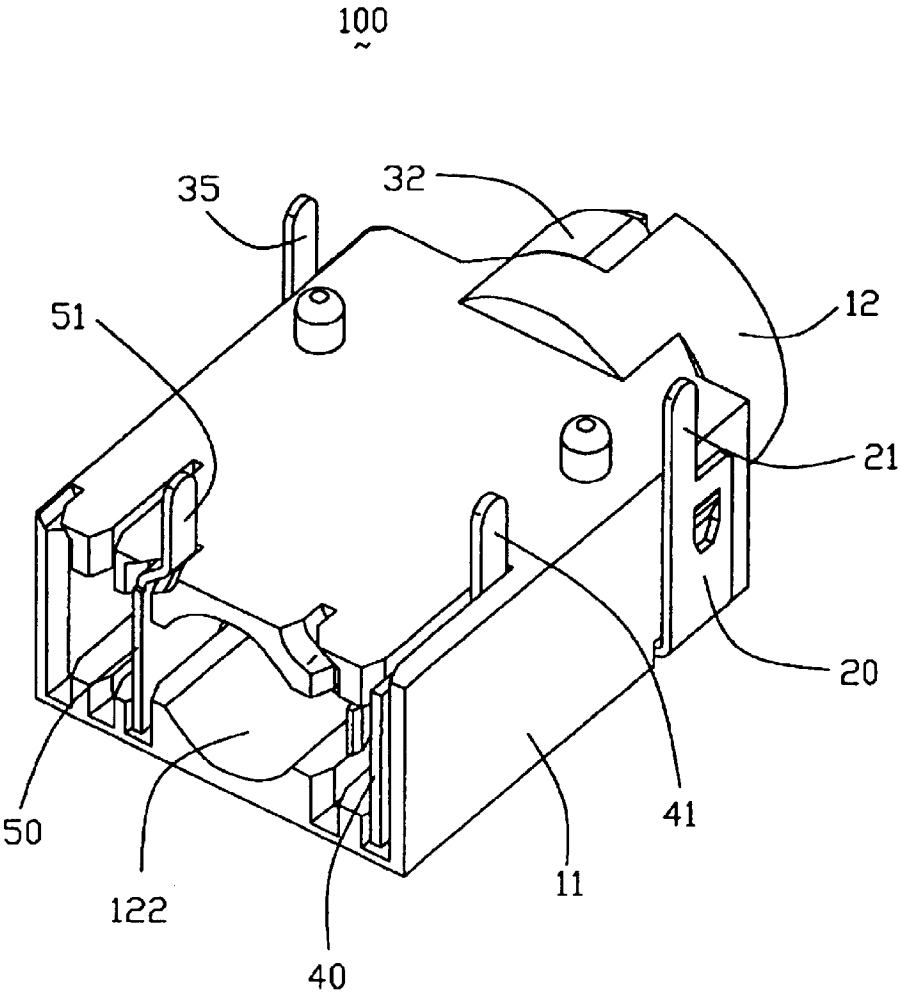
FIG. 2 is an assembled, perspective view of the audio jack connector of FIG. 1 from a bottom aspect.
Figure 3:
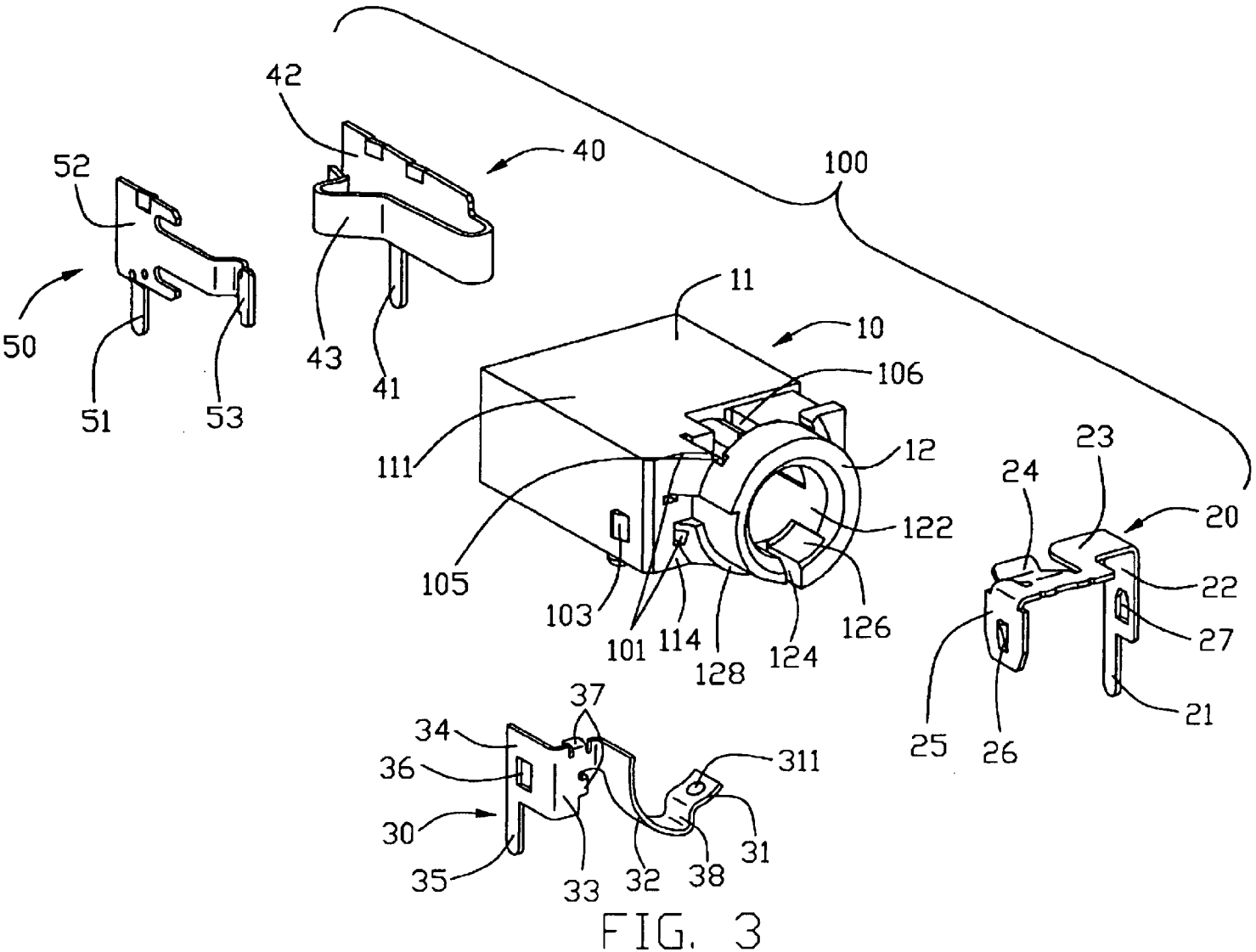
FIG. 3 is an exploded, perspective view of the audio jack connector of FIG. 1.
Figure 4:
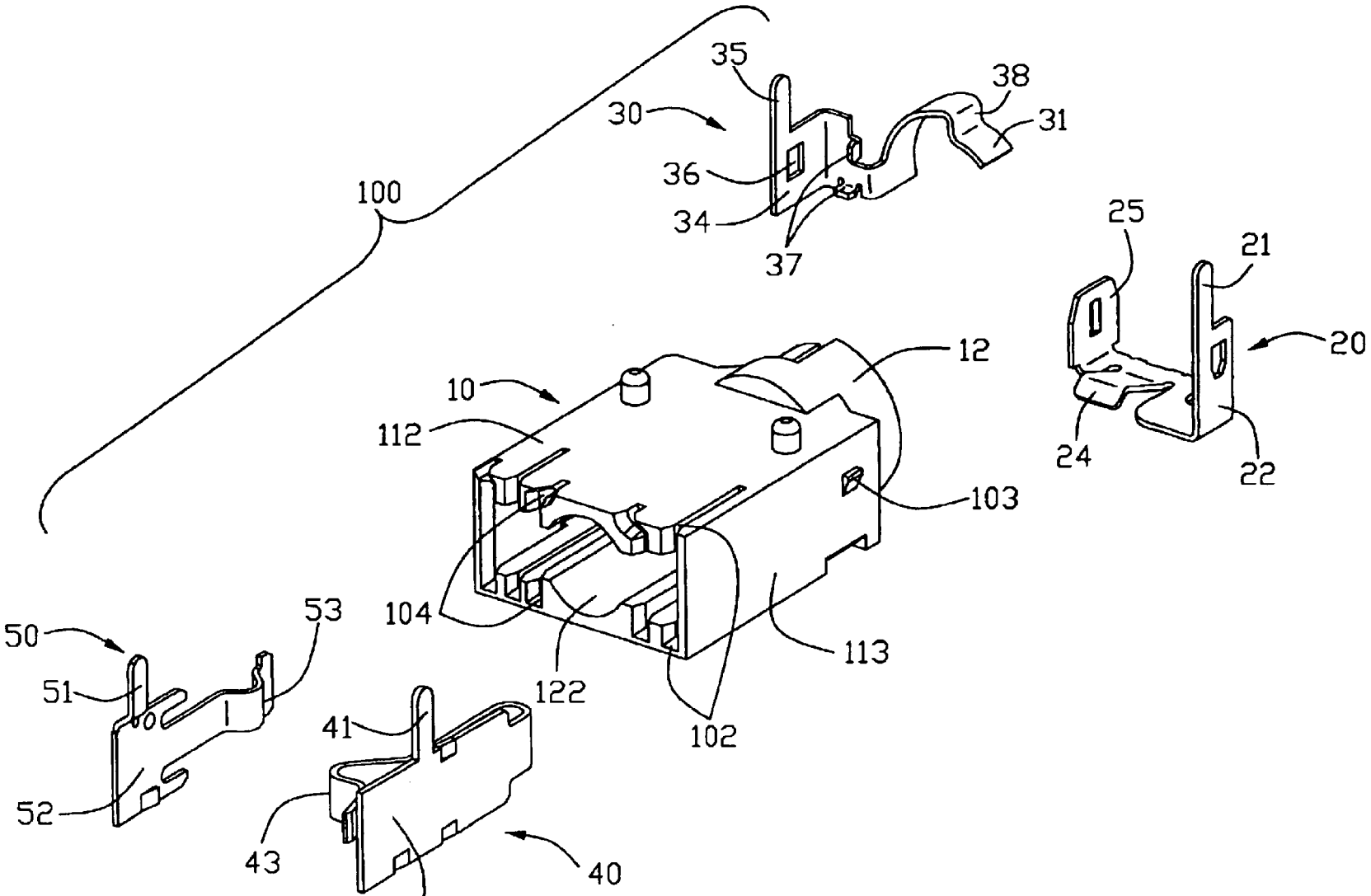
FIG. 4 is an exploded, perspective view of the audio jack connector of FIG. 2.

With reference to FIGS. 1 and 3, and in conjunction with FIGS. 2 and 4, an electrical connector in accordance with the present invention is an audio jack connector 100 and comprises an insulating housing 10, and a plurality of different contacts including a first, second, third, and fourth contact 40, 50, 20, 30.

Referring to FIGS. 3 and 4, the insulating housing 10 is generally in a rectangular shape. The housing 11 comprises a rectangular-shaped base 11, and a cylinder-shaped mating portion 12 extending forwardly from a front surface of the base 11. The mating portion defines a gap 124 at a front end of the mating portion 12 thereof. An inner and outer wall (not labeled) of the mating portion 12 defines respectively an inner, and outer receiving space 126, 128 thereof. A channel 122 at the front end of the mating portion 12 extending through the base 11 is mated with a mating plug connector (not shown). The base 11 defines a pair of first and second slits 102, 104 at a top wall 111 and an opposite bottom wall 112. The silts 102, 104 are positioned at both sides of the passageway 122 for receiving the first and second contacts 40, 50 respectively. A depression 106 is formed between the top wall 111 and the mating portion 12 and communicates with the passageway 122 through a hole in the depression 106. A crevice 105 adjacent to the depression 106 extends downwardly from the top wall 111 and a projection (not shown) forms at a side of the crevice 105. A pair of side walls 113 connecting the top, bottom walls 111, 112 each forms a locking member 103 at an out surface thereof. A pair of holes 101 defined at the same side of the front surface extend rearwardly from the front surface of the front wall 114.

The first contact 40 used for transmitting signals comprises a first retention portion 42 received in the slit 102, a first mounting portion 41 extending downwardly from the first retention portion 42, and a first engaging portion 43 extending forwardly and bent rearwardly from the first retention portion 42

The second contact 50 used for transmitting signals comprises a second retention portion 52 received in the slits 104, a second mounting portion 51 extending downwardly from the second retention portion 52, and a second engaging portion 53 extending forwardly from the second retention portion 52.

Referring to the FIGS. 1 and 3, the third contact 20 assembled to the housing 10 for transmitting signals comprises a right, left portion 22, 25 and a third connecting portion 23 connecting the right, second portion 22, 25, a third mounting portion 21 extending downwardly from the right portion 22, and a third engaging portion 24 extending rearwardly from the third connecting portion 23. The right, left portion 22, 25 respectively defines a locking hole 27, 26 thereof.

The fourth contact 30 is a grounding contact and comprises lateral portion 34 defining a securing hole 36, a fourth mounting portion 35 extending downwardly from a bottom side of the lateral portion 34, a fourth retention portion 33 extending vertically and inwardly from a front side of the lateral portion 34. The fourth retention portion 33 forms a pair of spring arms 37 at lateral sides thereof. An arc-shaped guiding portion 32 extends downwardly and forwardly from a right side of the fourth retention portion 33. A fourth connection portion 38 extends upwardly from the guiding portion 32. A fourth engaging portion 31 extends transversely and upwardly from the fourth connecting portion 38. The engaging portion 31 forms a salient 311 for contacting the mating plug connector and achieving an electrically connection.

Referring to FIGS. 2 and 4, in assembly, the first, second contacts 40, 50 are first assembled to the housing from a rear-to-front direction of the housing 10. The first, second retention portions 42, 52 of the first, second contacts 40, 50 are retained in the corresponding slits 102, 104, respectively. The first, second engaging portions 43, 53 are inserted into and received in the channel 122 for mating with the mating plug connector. The first, second mounting portions 41, 51 extend through and expose outside the bottom wall 112.

Referring to FIGS. 1 and 3. Secondly, the third contact 20 is then assembled to the mating portion 12 of the base 11 from an up-to-down direction of the housing 10. The right portion 22 mates with a right wall 113 of the housing 10 by mating with the locking member 103 and the locking hole 27. The third connecting portion 23 shields an area adjacent to the base 11 and the mating portion 12. The third engaging portion 24 is received in the depression 106 and extends into the channel 122. The left 25 is received in the crevice 105, the locking hole 26 of the left portion 25 mates with the projection of the crevice 105. The third mounting portion 21 extends through and exposes outside the bottom wall 112.

Thirdly, the fourth contact 30 is assembled to the housing 10 from a front-to-rear direction. The fourth engaging portion 31 is retained in the inner receiving space 126, the fourth connecting portion 38 is received in the gap 124, and the guiding portion 32 is retained in the outer receiving space 128. The fourth retention portion 33 rests against the front wall 114, and the spring arms are inserted into corresponding holes 101. The lateral side 34 is mated with a left wall 113 by mating with the locking member 103 and the locking hole 36.

The first, second, third, and fourth contacts of the present invention are assembled to housing 10 from an outside-to-inside direction of the housing. Therefore, the inner structure of the housing is simplified and so that the faults of manufacturing will be eliminated. The distribution of the first, second, third, and fourth contacts 40, 50, 20, 30 also increases a using rate of space of the housing 10 and prevents electromagnetic interference for achieving a good electrically connection.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An audio jack connector comprising:

a rectangular-shaped insulative housing comprising a base, a mating portion for mating with a mating plug connector, a channel extending through the base and the mating portion, a front end of the mating portion defining a gap, and a number of receiving slits defined on the base at two sides of the channel, the base defining a depression communicating with the channel at a top wall thereof;

a first and a second contacts received in the slits, each contact having a mounting portion extending through and exposed outside a bottom wall of the base, and an engaging portion extending into the channel for electrically connecting the mating plug connector;

a third contact mating with the top wall and comprising a mounting portion extending beyond the bottom wall of the base, a connecting portion received in the depression, and an engaging portion extending into the channel for electrically connecting the mating plug connector; and a fourth contact installed in a front end of the insulative housing and having a mounting portion extending beyond the bottom wall of the base, and an engaging portion extending through the gap and inserted into the front end of the mating portion for electrically connecting the mating plug connector, wherein the mating portion defines an inner recess at an inner wall thereof and an outer recess at an outer wall thereof;

wherein the inner recess of the mating portion is adjacent to the gap;

wherein the fourth contact comprises a connecting portion extending downwardly from the engaging portion and received in the gap;

wherein the engaging portion forms a salient for contacting the mating plug connector and achieving an electrically connection; and wherein the fourth contact comprises a guiding portion surrounding the outer recess of the mating portion.

2. The audio jack connector as described in claim 1, wherein the fourth contact comprises a retention portion extending rearwardly from a rear side of the guiding portion and mating with a front wall of the base.

3. The audio jack connector as described in claim 2, wherein the retention portion of the fourth contact has a pair of spring arms inserted into corresponding holes defined at the front wall of the base.

4. The audio jack connector as described in claim 2, wherein the fourth contact comprises a lateral portion defining a locking hole mating a locking member formed at a side wall of the base.

5. The audio jack connector as described in claim 4, wherein the lateral portion is vertical to the retention portion of the fourth contact.

* * * * *